US006550630B1

(12) United States Patent
Krupa

(10) Patent No.: US 6,550,630 B1
(45) Date of Patent: Apr. 22, 2003

(54) CONTAINER FOR FROZEN CAKE BATTER

(75) Inventor: Calvin S. Krupa, Medina, MN (US)

(73) Assignee: Blue Sky Foods, LLC, Rogers, MN (US)

( * ) Notice: Subject to any disclaimer, the term of this patent is extended or adjusted under 35 U.S.C. 154(b) by 0 days.

(21) Appl. No.: 10/108,290

(22) Filed: Mar. 27, 2002

(51) Int. Cl.[7] ..... B65D 21/00
(52) U.S. Cl. ..... 220/575; 220/669; 220/675
(58) Field of Search ..... 220/574, 575, 220/669, 675

(56) References Cited

U.S. PATENT DOCUMENTS 3,107,027 A * 10/1963 Hong ..... 220/575 X
5,593,062 A * 1/1997 Martin ..... 220/575 X
5,732,847 A * 3/1998 Caldi ..... 220/575
5,921,423 A * 7/1999 Howell et al. ..... 220/575 X
6,042,856 A * 3/2000 Sagan et al. ..... 220/575 X

* cited by examiner

*Primary Examiner*—Steven Pollard
(74) *Attorney, Agent, or Firm*—Thomas J. Nikolai; Nikolai & Mersereau, P.A.

(57) ABSTRACT

An improved container for freezing, storing and shipping pre-mixed frozen batter for baked goods which includes an integrally formed flexible base, flexible side wall and deformable post. The container is designed so that the frozen batter can be easily removed from the container when desired and placed in a baking pan for baking without the necessity of thawing the batter.

6 Claims, 3 Drawing Sheets

CONTAINER FOR FROZEN CAKE BATTER

BACKGROUND OF THE INVENTION

FIELD OF THE INVENTION

This invention relates to cakes. More specifically, the present invention relates to cakes that can be pre-mixed and frozen at one point in time and then later baked in an oven so that the cakes are fresh when served. The present invention provides an improved container in which pre-mixed cake batter can be deposited, frozen, stored and even shipped to another location.

Chefs, homemakers and virtually anyone who eats dessert all understand that cake tastes best when it is warm and fresh from the oven. Restaurants want to serve pleasing products to their patrons. Homemakers take pride in the quality of the food they serve their families. Both restaurants and homemakers encounter difficulties when it comes to serving cake.

The survival of many restaurants is dependent upon their ability to serve a large volume of customers at a reasonable price. Customers will not return if the service is too slow, the food is not tasty, or they were charged too much for the food they were served. This presents certain challenges for restaurant operators. They must efficiently provide food of an acceptable high quality to their patrons. This challenge is particularly difficult when it comes to serving desserts and particularly cakes. The shelf life of a baked cake is relatively short. Cakes quickly become stale. Cakes also occupy a significant amount of space and are relatively fragile. Customers will not be pleased if they are served a piece of cake that is either stale or crushed.

Homemakers face a different set of challenges. In many households there is only one adult. In households where there are two adults, both often work. Baking cakes from scratch or even using a cake mix requires a significant amount of set up, baking and clean-up time. Homemakers often cannot find the time it takes to bake a cake to serve as a dessert at dinner given the time pressures they are under working, raising a family and taking care of the home.

In view of the foregoing, it is clear that both restaurants and homemakers share a real desire to be able to serve freshly baked cakes with meals. They also share a need to be able to serve such cakes in a very time effective manner.

Over the past 50 years, the way food is marketed in America has changed drastically. Most restaurants are now part of a company-owned chain or are franchises. Similarly, supermarkets are more often than not operated as part of a chain or franchise. Corporations that operate chains and franchises must have consistent quality from store location to store location. Customers need to know what to expect in terms of quality whenever they enter a chain store or franchise.

Maintaining consistent quality is often difficult when supermarkets and restaurants sell baked goods. Differences in the quality of baked products can arise in such situations for at least two reasons. First, differences in the quality of the ingredients will result in differences in the final product. Second, differences in the capabilities and skills exercised by personnel involved in selecting, measuring and mixing the ingredients can affect the quality of the final product.

A variety of frozen or refrigerated, prepackaged, heat and serve products are now on the market. Some are marketed to restaurants. Others are marketed to homemakers. However, there still are no high quality, frozen, prepackaged bake and serve cakes on the market. This is principally because, to date, there has not been an effective way of manufacturing and delivering such cakes to restaurants and homes. Also, real inconsistency exists between the quality of baked products served at different stores operated by chains.

SUMMARY OF THE INVENTION

The present invention addresses the needs outlined above by providing a container in which premixed batter can be deposited, frozen, stored, and shipped. Use of the container is ideally suited for chain restaurant and supermarket operations which sell baked goods to ensure uniform quality of baked goods. Ingredients can be acquired and mixed at a central location. The batter can then be placed in the container of the present invention, frozen and then delivered to the restaurants or supermarkets of the chain. When the restaurant or supermarket is ready to sell the baked goods, the bakers at the restaurant or supermarket remove the frozen batter from the container, place it in a baking pan and then bake it in an oven. Set up and clean up are minimal. No mixing is required to occur in the restaurant or supermarket because this all occurred at the central location. Thus, with greater efficiency, baked products of uniform quality can be sold at each retail location operated by the restaurant or supermarket chain. The container of the present invention provides similar advantages for busy homemakers who want to be able to efficiently serve baked items to their families.

The container of the present invention has a variety of features which make it ideal for use with pre-mixed cake batter. The container includes a base, an outer sidewall extending upwardly from the outer edge of the base and an outwardly projecting rim that helps the sidewall maintain its shape. The base and sidewall are each made of a thin, flexible plastic material. Projecting upwardly from the center of the base toward the top of the container is a center post. The center post has a diameter which is approximately ⅓ that of the sidewall so that a trough is formed between the sidewall and the post. The pre-mixed batter is deposited, frozen and stored in the trough.

One unique feature of the container is the design of the post. The post has a wall, a top surface and a frusto-conical depression in the center of the post extending back toward the base of the container.

When the container is used, pre-mixed batter is deposited into the trough and frozen. The container is then covered, for example, by a piece of shrink-wrapped plastic. The cake batter can then be shipped to a supermarket, restaurant, home or other kitchen facility and stored in the container in a frozen state until just before the cake is to be served. The frozen cake batter is then removed from the container, placed in a baking pan, inserted into the oven and baked until done. Once the cake is baked, it can be cut and served hot and fresh.

The design of the container makes it quite easy to remove the frozen batter from the container. Pushing down on the bottom of the frusto-conical depression in the center post causes the base and wall of the post to separate from the frozen batter. Further manipulation serves to separate the sidewall of the container from the frozen batter. Once the surfaces of the container are separated form the batter, the frozen batter is easily removed from the container.

BRIEF DESCRIPTION OF THE DRAWINGS

The construction and advantages of the container of the present invention will be better understood from a review of the following detailed description of the preferred embodiment in conjunction with the accompanying drawings in which.

DETAILED DESCRIPTION OF THE INVENTION

Figure 1:
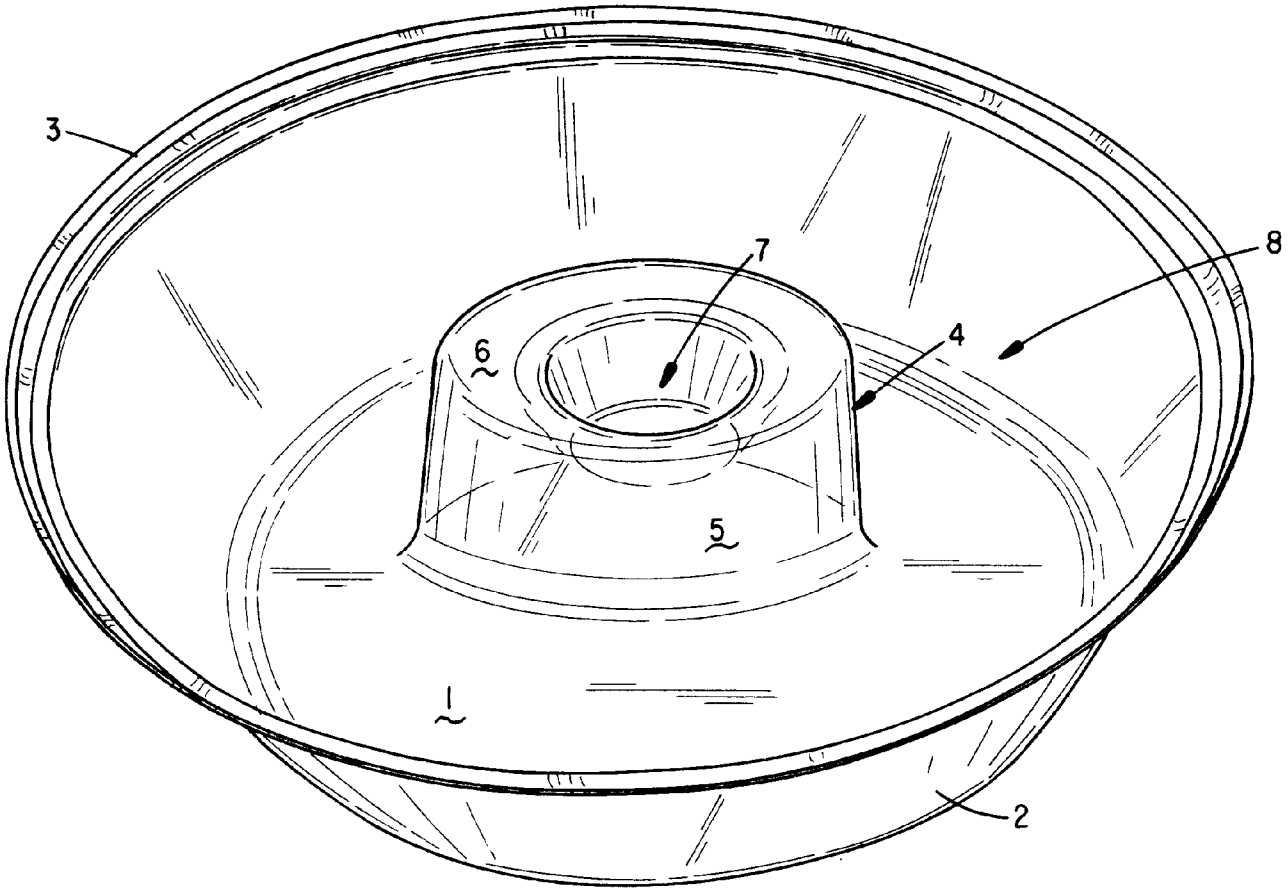
FIG. 1 is a perspective view of the container of the present invention.
Figure 2:
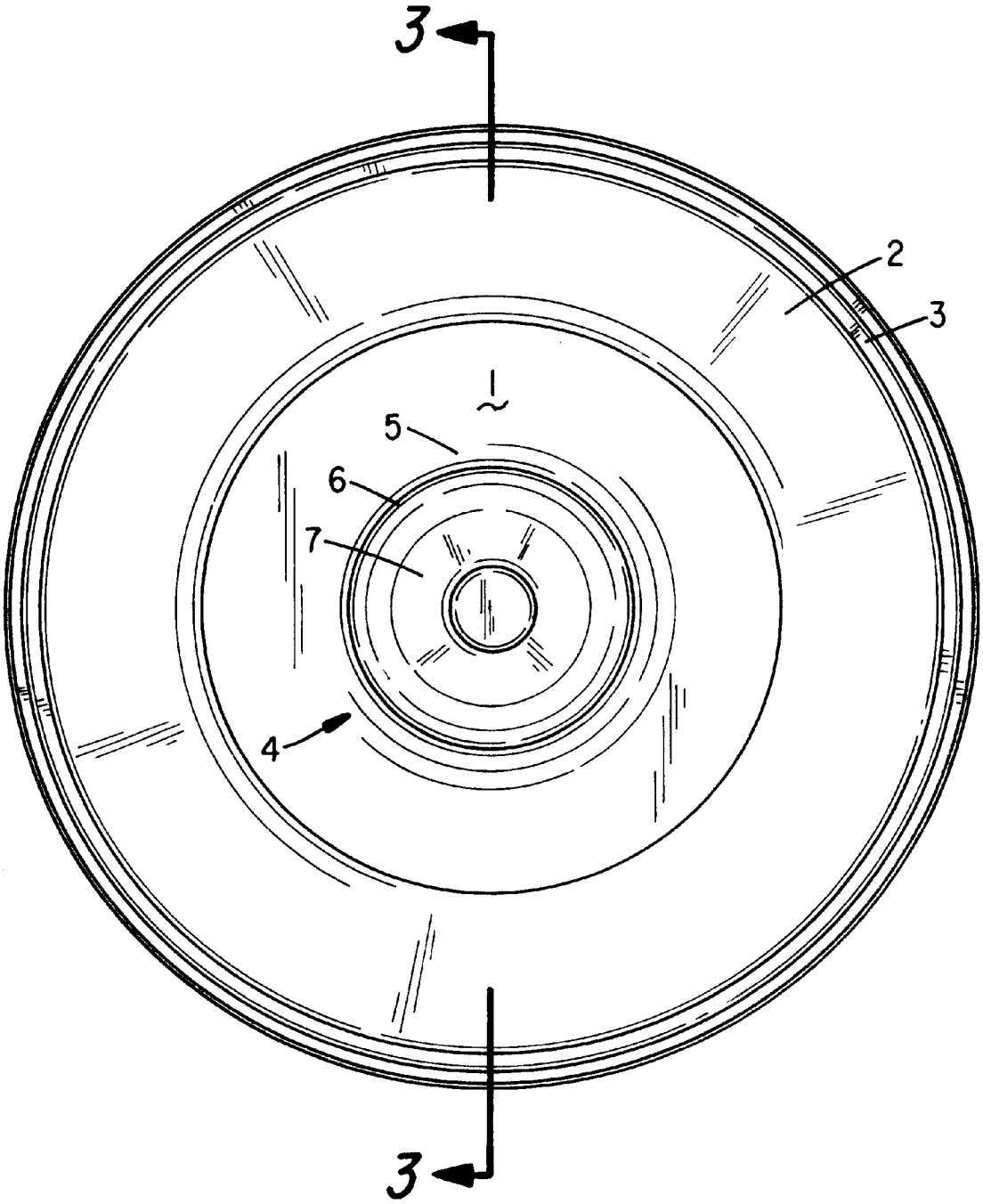
FIG. 2 is a top view of the container of the present invention.
Figure 3:
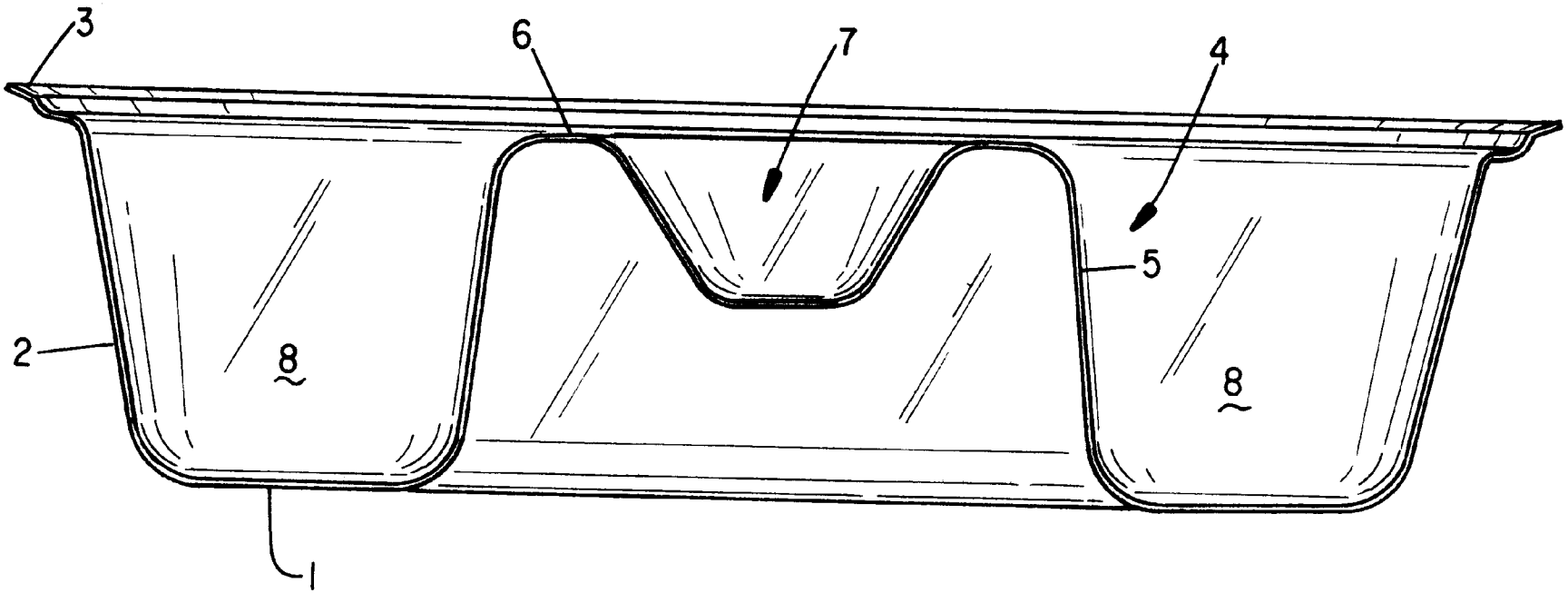
FIG. 3 is a cross sectional view through line 3—3 in FIG. 2.

As shown in the drawings, the container of the present invention includes a base 1 and an outside wall 2 extending upwardly from the base 1 which terminates in an outwardly projecting rim 3. The top of the container is open. The container also includes a deformable post 4 that projects upwardly from the base 1. The post 4 includes a wall 5, a top surface 6 and a depression 7 that extends from the top surface 6 back toward the base 1. A trough 8 is formed between the outside wall 2 and the wall 5 of the post 4. Preferably, the trough 8 surrounds the post 4 and is ring-shaped as shown. However, other shapes of the outside wall 2, post 4 and trough 8 can be selected without deviating from the invention. One advantage of the arrangement shown is that batter frozen in the trough 8 can later be placed in an angel food cake pan or other baking pan having a post for baking without having to first thaw the frozen batter.

Preferably, the container of the present invention will be integrally molded of a flexible plastic material such as polyethelene terathalate (PET). To save cost, and at the same time, provide suitable strength, rigidity and flexibility, the various surfaces of the container will be less than 20 mil thick and preferably only about 12 mil thick. If the material is too thin (less than 4 mil) it can rip or tear. This construction ensures that the base 1, outside wall 2, and the wall 5 of the post 4 are sufficiently flexible so that the frozen batter can be released from the container.

When in use, pre-mixed cake batter is deposited through the open top of the container into the trough 8. A cover (not shown) can then be provided to protect the batter from dust or other contaminants. The cover could, for example, be in the form of a shrink-wrapped film. A suitable cover will suffice. The batter can then be frozen in the container. The container permits the frozen batter to be stored and shipped.

When one desires to bake a cake from the frozen batter, the frozen batter is removed from the container for baking. To do so, the cover is removed. By pushing down on the post 4, one can release the frozen batter from the wall 5 of the post 4 and the base 1. The depression 7 provides several advantages when performing this step. The bottom of the depression 7 provides a surface against which someone can push to deform the post 4. The void created by the depression also provides an area that the material of the post 4 can move into to assist in releasing the frozen batter from the post. The flexible outer wall 2 can also be manipulated to release the frozen batter from the outer wall 2. The container then can be tipped upside down over a baking tray to deposit the frozen batter on the baking tray. The baking tray and frozen batter are then placed in an oven to bake the cake. When baking is complete, the cake is removed from the oven and served.

Modifications to the container described above can, of course, be made without deviating from the invention. Thus, it is intended that the patent be given the broadest permissible scope consistent with the following claims.

What is claimed is:

1. An integrally molded plastic container for storing batter, said container comprising:

a. a flexible base;

b. a flexible outside wall projecting upwardly from the base;

c. a deformable post projecting upwardly from said base, said post including a first wall which cooperates with said outside wall and said base to form a though in which said batter is deposited and stored, said deformable post further including a top surface, a second wall and a bottom surface, said second wall and said bottom surface defining a depression that surrounds a void, wherein when pressure is applied to the bottom surface from above, said post is deformed such that a substantial portion of said post collapses into said void.

2. The container of claim 1 further including a cover.

3. The container of claim 1 wherein said container is integrally formed of polyethelene terathalate (PET).

4. The container of claim 1 wherein the base, outside wall and first and second walls of the post are all less than 20 mil thick.

5. The container of claim 1 wherein said container is integrally formed of polyethelene terathalate (PET) and the base, outside wall and first and second walls of the post are each between 4 mil and 20 mil thick.

6. The container of claim 1 wherein said trough is ring-shaped and surrounds said deformable post.

* * * * *

UNITED STATES PATENT AND TRADEMARK OFFICE

CERTIFICATE OF CORRECTION

PATENT NO. : 6,550,630 B1
DATED : April 22, 2003
INVENTOR(S) : Calvin S. Krupa

It is certified that error appears in the above-identified patent and that said Letters Patent is hereby corrected as shown below:

Column 4,
Line 26, the word “though” should read -- trough --.

Signed and Sealed this

Twenty-fourth Day of June, 2003

JAMES E. ROGAN
*Director of the United States Patent and Trademark Office*